United States Patent [19]

Genovese et al.

[11] Patent Number: 4,664,982

[45] Date of Patent: May 12, 1987

[54] MULTI-LAYER COMPOSITE STRUCTURE

[75] Inventors: John S. Genovese, Flemington; Edwin C. Grazul, Edison; David J. Meisner, Monmouth Beach; Francis M. Wright, Middletown, all of N.J.

[73] Assignee: American Standard Inc., New York, N.Y.

[21] Appl. No.: 729,391

[22] Filed: May 1, 1985

Related U.S. Application Data

[63] Continuation of Ser. No. 514,383, Jul. 25, 1983, abandoned.

[51] Int. Cl.[4] ..... A47K 3/22; B32B 3/00; B32B 3/02

[52] U.S. Cl. ..... 428/447; 428/318.4; 428/319.1; 428/319.3; 428/319.7; 428/450; 428/451; 428/448

[58] Field of Search ..... 428/318.4, 319.1, 319.3, 428/319.7, 340, 446, 448, 450, 451, 447; 4/584

[56] References Cited

U.S. PATENT DOCUMENTS

| | | | |
|---|---|---|---|
| 2,407,515 | 9/1946 | Roberts | 428/319.1 X |
| 3,030,249 | 4/1962 | Schollenberger et al. | 428/318.4 X |
| 3,172,775 | 3/1965 | Shaines | 117/68 |
| 3,252,155 | 5/1966 | Surtees et al. | 428/319.1 X |
| 3,496,058 | 2/1970 | Schroter et al. | 161/119 |
| 3,511,788 | 5/1970 | Keil | 428/318.4 |
| 3,823,098 | 7/1974 | Joslyn | 260/25 |
| 3,823,099 | 7/1974 | Doyle | 260/2.5 |
| 3,826,629 | 7/1974 | Pryor et al. | 428/319.1 X |
| 3,978,018 | 8/1976 | Self | 260/40 R |
| 4,011,195 | 3/1977 | Self | 260/40 R |
| 4,013,614 | 3/1977 | Self | 260/40 R |
| 4,027,442 | 6/1977 | Silverman | 428/319.1 X |
| 4,053,545 | 10/1977 | Fay | 264/46.4 |
| 4,061,613 | 12/1977 | Self | 260/40 R |
| 4,126,719 | 11/1978 | Koyanagi et al. | 428/251 X |
| 4,179,760 | 12/1979 | Nakagawa | 4/584 |
| 4,216,294 | 8/1980 | Halle et al. | 521/99 |
| 4,316,294 | 2/1982 | Baldwin | 4/584 X |
| 4,358,548 | 11/1982 | Saidla | 521/128 |

FOREIGN PATENT DOCUMENTS 1028908 5/1966 United Kingdom .

OTHER PUBLICATIONS

Hackh's Chemical Dictionary, 9th Ed., p. 609.
Silane Coupling Agent (Dow Corning) 1981.
US Peroxygen, Witco Chemical Corporation Bulletin (2-81).

*Primary Examiner*—Nancy A. Swisher
*Attorney, Agent, or Firm*—James J. Salerno, Jr.; Robert G. Crooks; John P. Sinnott

[57] ABSTRACT

A composite structure, e.g., a plastic-backed enamel steel product having high impact and thermal shock resistance is disclosed. The composite structure is formed having bonded thereto, a finished layer on one side thereof, and on the other side a layer of reinforced plastic to form a laminated structure. The plastic layer has a thickness of at least ⅛ in., and a density of between about 20 lbs. per cu.ft. and about 125 lbs per cu.ft. The finished layer is resistant to delamination when subjected to relatively high impact applied directly to the finished and/or plastic layer surface and to delamination when the composite structure is subjected to a sudden temperature change of about 180° F.

15 Claims, 8 Drawing Figures

MULTI-LAYER COMPOSITE STRUCTURE

This application is a continuation of application Ser. No. 514,383, filed July 25, 1983, now abandoned.

BACKGROUND OF THE INVENTION

This invention relates to a multi-layer composite structure, and in particular, to a composite structure having a plastic chemically bonded to the substrate of the composite structure to impart resistance to delamination when subjected to impact and/or thermal shock.

Many attempts have been made by industry to make a multi-layer composite structure including at least a substrate of appreciable strength and stiffness, wherein the layers are resistant to delamination when subjected to high impact or when subjected to thermal shock. When subjected to high impact from either side of the structure, one of the layers, the finish layer, may deform, crack, craze, or chip, and another layer, i.e., a plastic layer, may delaminate from the substrate. Delamination may also occur when the composite structure is subjected to thermal shock.

U.S. Pat. No. 3,172,775 discloses a structure of ceramic-coated asbestos fibers impregnated with a thermoplastic or thermosetting resin. The ceramic material, in the form of a frit, is fused to the asbestos fibers. The resin is allowed to impregnate the ceramic fibers to form a bond. In U.S. Pat. No. 3,496,058, a semi-elastic layer, containing particulate material such as sand, is applied to one side of an aluminum sheet, and to this layer, a plastic foam is applied. If the semi-elastic layer were not used, tthe aluminum would be dented if subjected to impact by a one-pound metal ball dropped through a distance of 3 feet. In U.S. Pat. No. 4,053,545, a thermoplastic sheet is reinforced by injecting a plastic foam into a mold. Bonding is achieved through melting of the thermoplastic sheet, or an adhesive coating is applied to the thermoplastic sheet to firmly bond the sheet to the foam. In U.S. Pat. No. 4,216,294, a rigid or semirigid structure, such as a fiberglass-reinforced polyester panel, for example in the form of a boat, has applied thereto a polyester foam. The polyester foam is used because of its excellent adhesion to a like material. U.S. Pat. Nos. 3,823,099 and 4,358,548 describe polyester-foam-resin systems which form both rigid and flexible open-or-closed-cell foam products. The foams can be employed in operations such as spray-up, hand-layup, press molding, expansion casting RIM or RRIM, and resin-transfer molding.

SUMMARY OF THE INVENTION

The present invention is directed to a multi-layer composite structure including at least a substrate of appreciable strength and stiffness. The composite structure is formed having at least one surface to which a layer of plastic is chemically bonded, whereby the composite structure is characterized by high resistance to impact and delamination of the plastic and finish layers from the substrate. The composite structure also has high resistance to thermal shock. Unexpectedly, it has been found that the invention is particularly useful where the substrate is a plumbing fixture such as an enameled-steel bathtub, shower receptor, lavatory, kitchen sink, or a wall panel. In such a structure, the impact and delamination properties are equal to or better than for cast iron, enameled steel, or fiberglass-reinforced polyester with either an acrylic or gel-coat-finished product of the same configuration.

An object of the present invention is to provide a plastic-backed enameled-steel plumbing fixture that is resistant to chipping, cracking, crazing, delamination or deformation when subjected to high impact from either the finished or the reverse side, as when compared to presently available porcelainized cast-iron or enameled-steel plumbing products.

Another object of the invention is to provide a composite structure having bonded thereto a finished layer on one side thereof and on the other side a layer of plastic which is resistant to delamination when subjected to thermal shock.

A further object of the invention is to provide a plastic having a silane coupling agent to bond it to an enameled-steel surface.

Still another object of the invention is to provide an enameled-steel composite structure having a reinforced-plastic layer chemically bonded to one side of the enameled-steel structure.

A still further object of the invention is to provide a relatively inexpensive method for bonding a resin layer to an enameled-steel plumbing fixture.

DETAILED DESCRIPTION OF THE INVENTION

Figure 1:
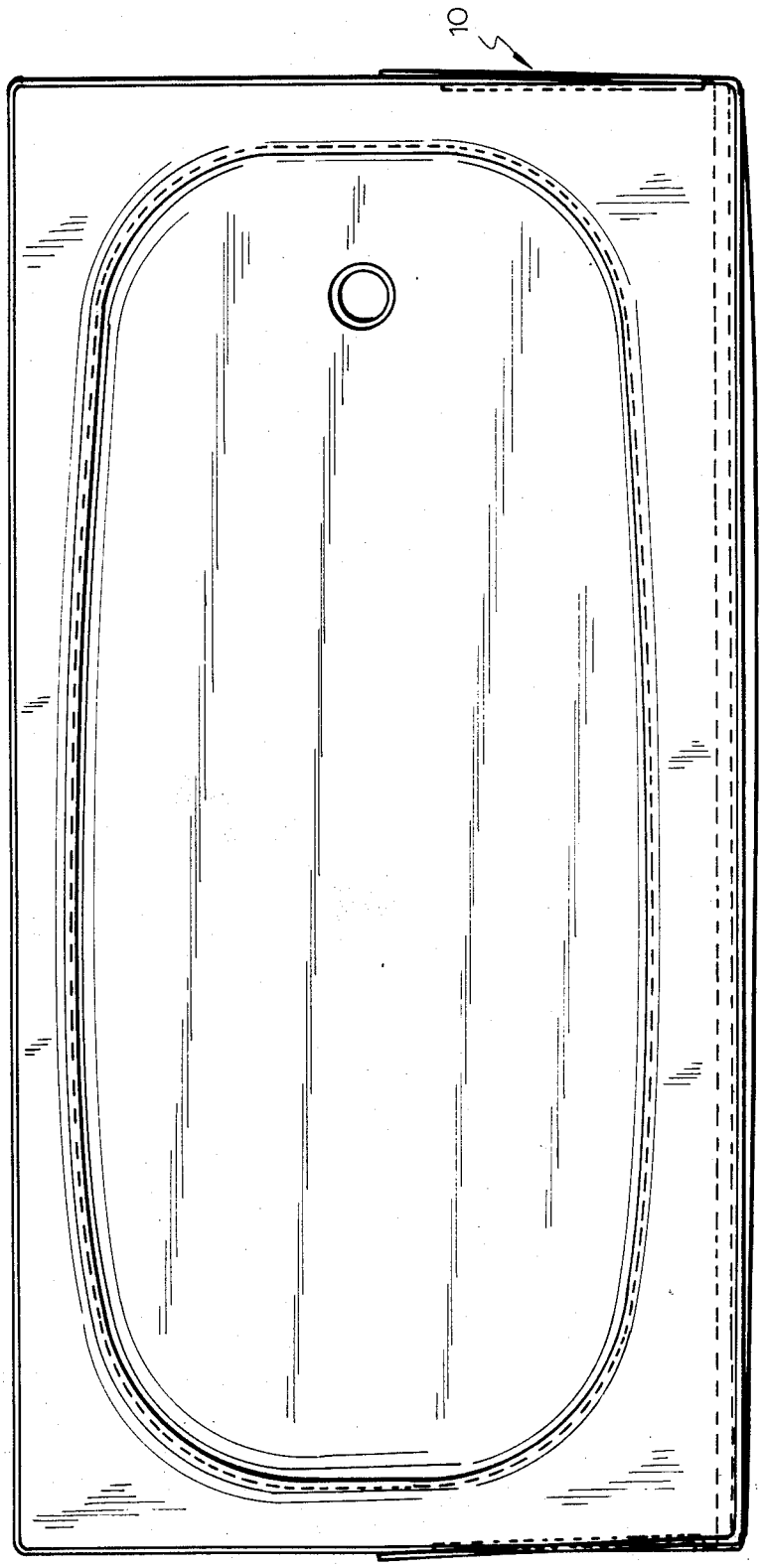
FIG. 1 is a top plan view of an enameled-steel bathtub constructed in accordance with the invention.
Figure 2:
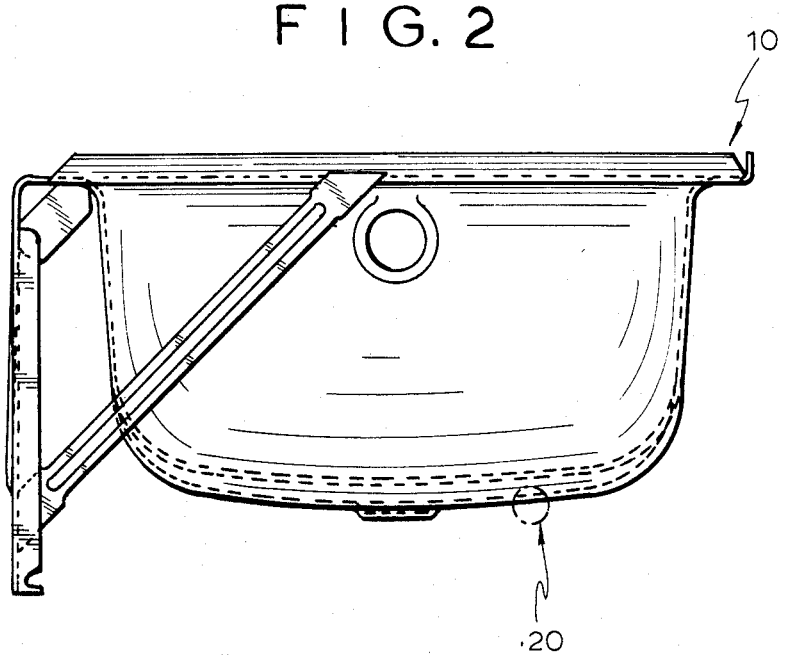
FIG. 2 is an elevational view of one end of the bathtub of FIG. 1.
Figure 8:
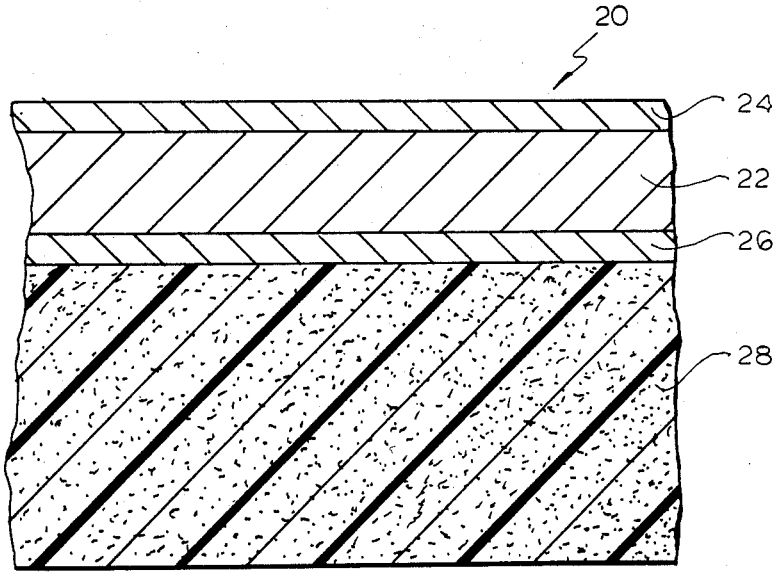
FIG. 8 is a greatly enlarged sectional view taken from within the broken line circles of FIGS. 2, 4, 6 and 7 which illustrates the composite structure of the invention.
Figure 3:
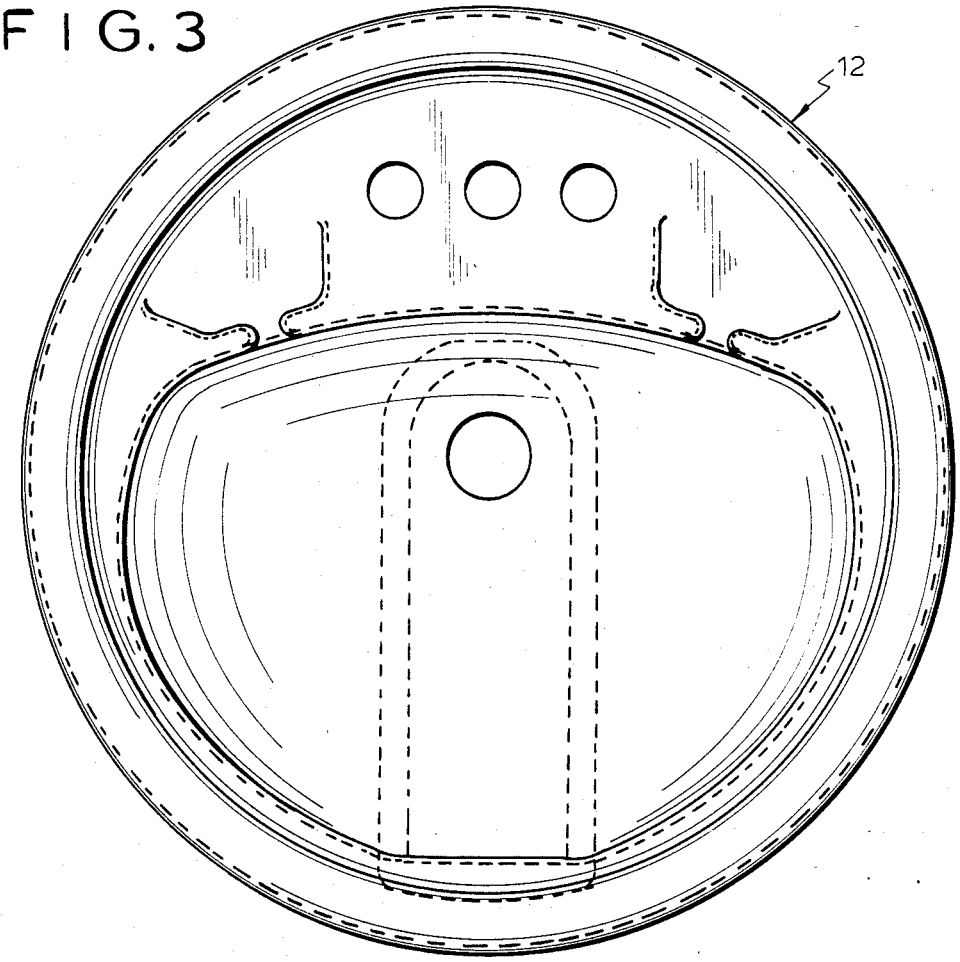
FIG. 3 is a top plan view of an enameled-steel lavatory constructed in accordance with the invention.
Figure 4:
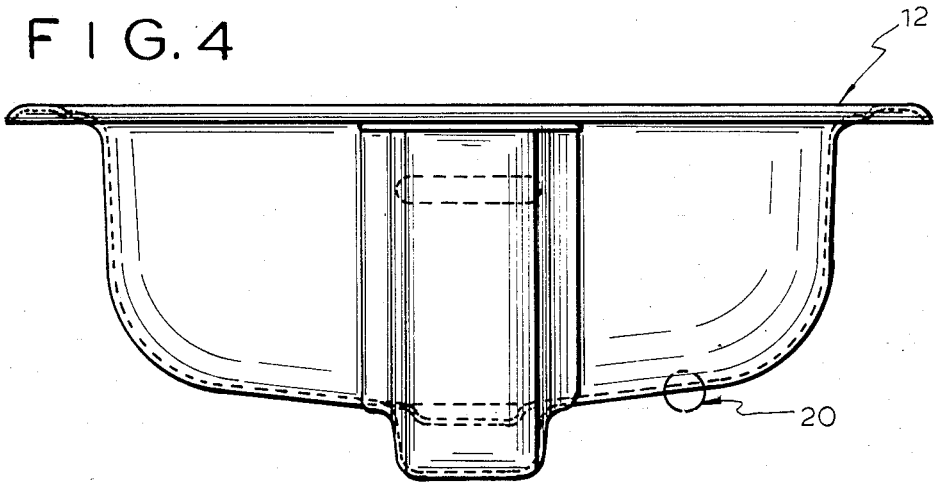
FIG. 4 is an elevational view of the lavatory of FIG. 3.
Figure 5:
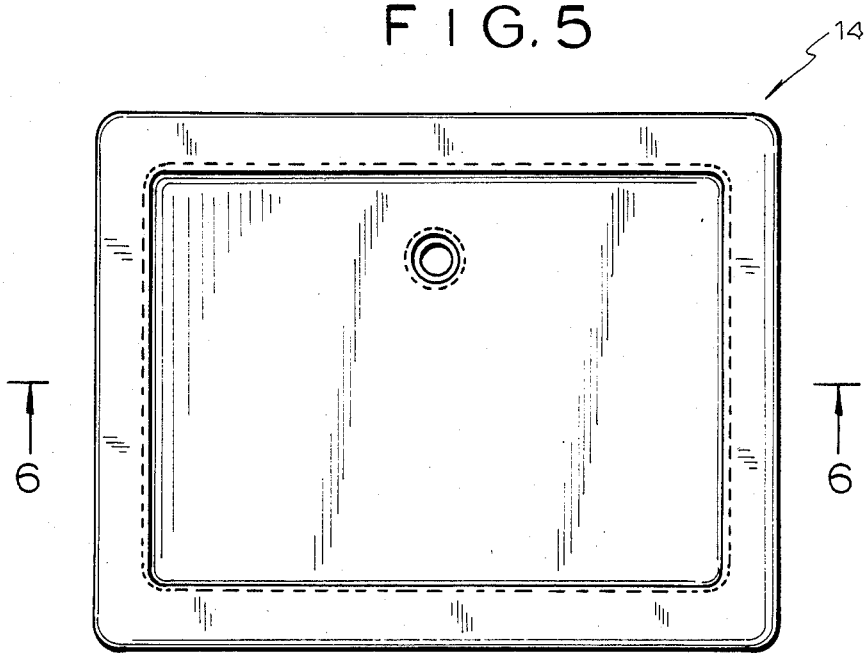
FIG. 5 is a top plan view of an enameled-steel shower receptor constructed in accordance with the invention.
Figure 6:
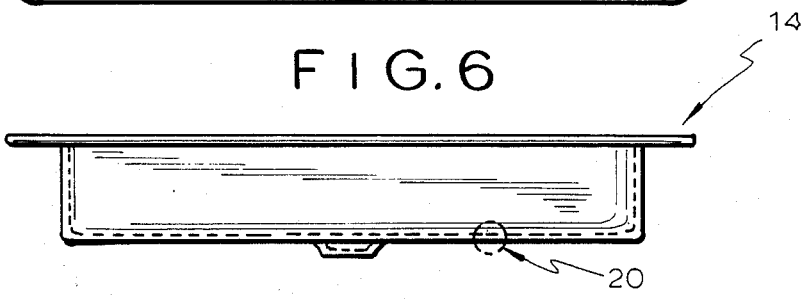
FIG. 6 is an elevational view of the shower receptor of FIG. 5.
Figure 7:
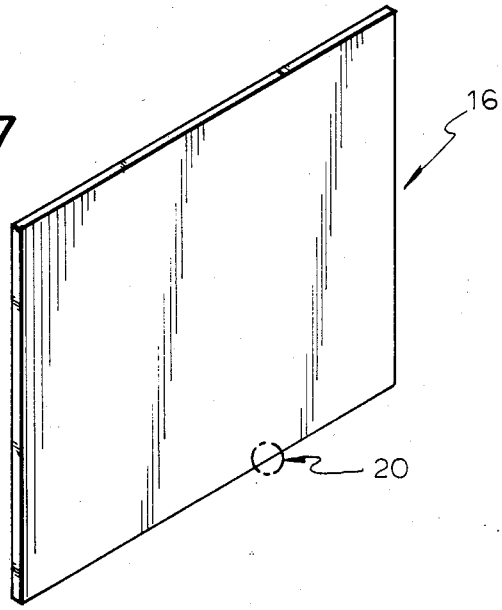
FIG. 7 is an isometric view of an enameled-steel panel constructed in accordance with the invention.

In FIGS. 1–6, enameled-steel plumbing fixtures and an enameled-steel wall panel such as is used for bathtub surrounds or shower stalls are constructed in accordance with the present invention. Bathtub 10, FIGS. 1 and 2, lavatory 12, FIGS. 3 and 4, shower receptor 14, FIGS. 5 and 6, and wall panel 16, FIG. 7 are all formed having the composite structure 20 shown in FIG. 8. Composite structure 20 includes a substrate 22 in the form of steel to which enamel layers 24, 26 are bonded on either side thereof. As generally practiced in the manufacture of enameled-steel plumbing fixtures, the enamel layers 24, 26 have a thickness in the range of about 1/64 to 1/32 of an inch. The enamel consists of inorganic oxides with a high concentration of silicon dioxide, forming a glassy layer when fused to the steel substrate 22. After the plumbing fixture or wall panel has been enameled, a plastic layer 28 is bonded to the enamel layer 26. The plastic may be applied for example, by spray-up, hand lay-up, RIM, RRIM, or RTM. The thickness of the plastic layer 28 may vary. For example, in the bathtub shown in FIG. 2, the side walls thereof may have a thickness of plastic as little as $\frac{1}{8}$ of an inch and the base or sump as little as $\frac{1}{4}$ inch. Such thicknesses are adequate to provide an effective amount of plastic on bathtub 10 so that it is resistant to chipping, cracking, crazing, deformation and delamination when subjected to impact forces of energy levels to which an unreinforced product would not be resistant. Also, the plastic layer resists delamination when subjected to thermal shock.

Various resins may be used in practicing the present invention, for example, unsaturated polyester containing vinyl monomer, epoxy, polyurethane, isocyanurate, nylon and others. The resin may be either foamed or unfoamed, with or without a filler such as glass fibers and/or aluminum trihydrate when bonded to an enameled-steel structure. When using unsaturated polyester resin containing a vinyl monomer, the bonding materials or couplers found suitable are the silane coupling agents such as a vinyl silane, for example, 3[2(vinyl benzylamino)ethylamino]propyltrimethoxy silane.

The resin can be filled to provide reinforcement by any suitable material, for example: glass spheres, fibers and weaves; ceramic spheres and fibers; boron; carbon fibers; graphite; wollastonite; an aromatic polyamide fiber, by Dupont Co., and others.

The enameled-steel fixture is incorporated into the composite structure by means of insert-molding techniques. The resin mixture is introduced into the mold to provide a packing factor of from about 20% to 100%. The packing factor is the ratio of the volume of resin mixture to the volume of the mold.

A typical resin mixture is formulated of the following compounds and materials:

| | Parts |
|---|---|
| Unsaturated Polyester Resin Containing Vinyl Monomer (Pioneer 236) | 100 |
| Aluminum Trihydrate | 100 |
| $\frac{1}{4}$" Chopped Fiberglass (OCF 832-FC) | 5 |
| Cumene Hydroperoxide | 0.5 |
| Dimethylethanolamine | 3.5 |
| Polymethylene Polyphenylisocyanate (Upjohn Papi 901) | 10 |
| Silicone Surfactant (Dow Corning 193) | 0.3 |
| Pigment | 0.5 |
| Water | 0.25 |

In practicing the invention, it is preferred that the RIM or RRIM process be employed although other means for applying the resin, whether it is foamed or unfoamed, may be used. For example, an enameled-steel plumbing fixture such as a bathtub is placed in a mold in which a resin, such as an unsaturated polyester containing a vinyl monomer, with or without a filler, a reinforcement, a surfactant, a catalyst, a blowing agent and a vinyl silane coupler which can be part of the mixture or can be applied to the fixture as a primer are mixed under high pressure, injected into the mold, and allowed to cure. The mold cycle is at least 1 minute for particulate composite structures or about 3 minutes for a bathtub. The enameled-steel bathtub is removed from the mold. The resulting plastic-backed bathtub has bonded thereto a resin foam layer of an unsaturated polyester-polyurethane copolymer which is resistant to delamination when subjected either to high impact forces or thermal shock. Further, the finished enamel surface 24 is resistant to chipping, cracking, or crazing when subjected to direct impact forces and resists deformation and pop-off of the finished layer when subjected to reverse forces such as are encountered during installation or shipping.

The physical properties and characteristics of the plastic-backed enameled-steel composite structure are equal to or better than most of the physical properties or characteristics of existing state-of-the-art sanitaryware products. The improved product performance is exemplified by the impact test results shown in the following tables.(1) Table I shows the impact that is required to cause damage to the finished surface when the impact is applied to the finished surface of the sanitaryware and is the type of damage that may result after its installation. Table II shows the results of the reverse-impact test, that is, when the load is applied to the plastic-backed surface of the sanitaryware and is the type of damage caused by handling, trucking, and installation.

(1) Testing procedure followed is that of American National Standard Z 124.1-1980 4.3 Impact loads except that the test area has a 3" unsupported diameter.

TABLE I

Direct Impact

| Sanitaryware | Impact To Cause Damage(2) To Finished Surface (Ft-Lb) |
|---|---|
| Fiberglass-Reinforced Polyester/Gel Coat | 1.50 |
| Fiberglass-Reinforced Polyester/Acrylic | 2.00(3) |
| Enameled Steel | 1.25 |
| Enameled Cast Iron | 1.75 |
| Plastic-Backed Enameled Steel of the Present Invention | 2.50 |

TABLE II

Indirect Impact

| Sanitaryware | Impact To Cause Damage(2) To Finished Surface (Ft.-Lb) |
|---|---|
| Fiberglass-Reinforced Polyester/Gel Coat | 1.0 |
| Fiberglass-Reinforced Polyester/Acrylic | 2.5 |
| Enameled Steel | 1-2 |
| Enameled Cast Iron | 1-2 |
| Plastic-backed Enameled Steel of the Present Invention | 5 |

(2)Damage is defined as a craze, dent or material delamination of the finished surface layer.

(3)Incipient structural damage with surface cracking observed at an impact energy level of 4.0 ft-lbs.

Another physical property of the plastic-backed enameled-steel structure of the present invention is its ability to resist thermal shock. A product such as a wall panel is subjected to temperatures of approximately 180° F., thereafter the panel is removed from the temperature source and placed in a temperature environment of zero degrees or below, for example, a freezer. The change in temperature of 180° F. does not cause delamination of the plastic layer from the enameled-steel panel.

What is claimed is:

1. A thermal-shock resistant composite structure comprising:

a metal substrate having a ceramic enamel layer on at least one side thereof;

said ceramic enamel layer having bonded thereto a layer of plastic including a [3[2(vinyl benyzlamino)ethylamino]propyltrimethoxy] silane coupler to form a reinforced laminate;

said plastic layer having a thickness of at least $\frac{1}{8}$ in. and having a density between about 20 lbs. per cu. ft. to about 125 lbs. per cu. ft. whereby said plastic layer is resistant to delamination when subjected to a sudden temperature change of at least about 180° F.

2. The composite structure in accordance with claim 1 in which said plastic layer has a thickness of at least about ⅛ inch.

3. The composite structure in accordance with claim 1 in which the structure has the configuration of a plumbing fixture.

4. The composite structure in accordance with claim 1 in which said plastic is a foam having a packing factor between about 20% and about 100% by volume.

5. A high-impact composite structure comprising:

a metal substrate having a ceramic enamel layer on at least one side thereof;

said ceramic enamel layer having bonded thereto a layer of plastic to form a high-impact-resistant laminate and a finished layer on the other side of said substrate;

said plastic layer including a [3[2(vinyl benzlamino) propyltrimethoxy] silane coupler and having a thickness of at least ⅛ in. and a density of about 20 lbs. per cu. ft. to about 125 lbs. per cu. ft. whereby said plastic layer of said composite structure is resistant to delamination when subjected to an impact of at least about 2.0-lbs. applied to the finished layer and when an impact of at least about 3.0 ft.lbs. is applied to the surface of said plastic layer.

6. The composite structure in accordance with claim 5 in which said composite structure has the configuration of a plumbing fixture.

7. The composite structure in accordance with claim 5 in which said substrate is a ceramic enameled-steel bathtub.

8. The composite structure in accordance with claim 5 in which said substrate is a ceramic enameled-steel sink.

9. The composite structure in accordance with claim 5 in which said substrate is a ceramic enameled-steel shower receptor.

10. The composite structure in accordance with claim 5 in which said substrate is a ceramic enameled wall panel.

11. The composite structure in accordance with claim 5 in which said plastic is an unsaturated polyester-polyurethane copolymer.

12. The composite structure in accordance with claim 5 in which said plastic is reinforced by a material selected from the group consisting of glass spheres, glass fibers, glass weaves, ceramic fibers, ceramic spheres, boron, carbon and graphite fibers, wollastonite and aromatic polyamide fiber.

13. The composite structure in accordance with claim 12 in which said plastic is a glass-reinforced unsaturated polyester-polyurethane copolymer.

14. The composite structure in accordance with claim 5 in which said plastic is an unsaturated polyester-polyurethane copolymer foam and may be porous or non-porous or combinations thereof.

15. The composite structure in accordance with claim 5 in which said plastic contains a surfactant.

16. The composite structure in accordance with claim 1 wherein said coupler is 3[2(vinyl benzylamino) propyltrimethoxy silane.

17. The composite structure in accordance with claim 5 where said coupler is 3[2(vinyl benzylamino) propyltrimethoxy silane.

* * * * *

UNITED STATES PATENT AND TRADEMARK OFFICE

CERTIFICATE OF CORRECTION

PATENT NO. : 4,664,982

DATED : May 12, 1987

INVENTOR(S) : Genovese et al.

It is certified that error appears in the above-identified patent and that said Letters Patent is hereby corrected as shown below:

Column 4, line 63, after "a", delete "[3[ 2(vinyl beny-".

Line 64, before "silane", delete "zlamino)ethylamino] propyltrimethoxy]."

Column 5, line 19, after "a", delete "[3[ 2(vinyl benzlamino)"

Line 20, before "silane", delete "propyltrimethoxy".

Column 6, line 29, after "benzylamino)", insert ...ethylamino]...

Line 32, after "benzylamino)", insert ...ethylamino]...

Signed and Sealed this

First Day of September, 1987

*Attest:*

*Attesting Officer*

DONALD J. QUIGG

*Commissioner of Patents and Trademarks*